United States Patent [19]

Allam

[11] Patent Number: 4,527,644

[45] Date of Patent: Jul. 9, 1985

[54] DRILLING BIT

[76] Inventor: Farouk M. Allam, P.O. Box 5864, Norman, Okla. 73070

[21] Appl. No.: 479,038

[22] Filed: Mar. 25, 1983

[51] Int. Cl.[3] ..... E21B 10/04

[52] U.S. Cl. ..... 175/333; 175/336; 175/348

[58] Field of Search ..... 175/333, 336, 349, 348, 175/406

[56] References Cited

U.S. PATENT DOCUMENTS

| | | | |
|---|---|---|---|
| 1,637,594 | 8/1927 | Stewart | 175/336 |
| 1,996,322 | 4/1935 | Carlson | 175/349 |
| 2,086,751 | 7/1937 | Taylor | 175/336 |
| 2,297,157 | 9/1942 | McClinton | 175/336 |
| 2,549,420 | 4/1951 | Camp | 175/333 |
| 2,587,429 | 2/1952 | Arutunoff | 175/333 |
| 2,667,334 | 1/1954 | Ortloff | 175/333 |
| 2,738,166 | 3/1956 | Koch | 175/333 |
| 3,418,022 | 12/1968 | Peterson | 175/333 |
| 3,915,246 | 7/1975 | Sheshtawy | 175/317 |
| 4,186,628 | 11/1980 | Bonnice | 76/108 A |
| 4,217,966 | 8/1980 | Garrett | 175/348 |

OTHER PUBLICATIONS

Cortes, "Core-Crusher Bit Drills Faster, Eliminates Nose Wear," *Oil and Gas Journal*, Jun. 23, 1980, at 111-15.

*Primary Examiner*—William F. Pate, III

*Attorney, Agent, or Firm*—Dunlap & Codding

[57] ABSTRACT

A drilling bit comprising a drill body formed from a base portion and a crown portion having a plurality of cutting elements; the base and crown portions are interengaged by a connection portion. An external opening in the crown portion communicates with a core-receiving section in the connecting portion. A core milling assembly, comprising a pair of rotatable, frustum-shaped rotary members, is supported in the connecting section. Each rotary member carries a plurality of cutting elements. During drilling, a core is received in the core-receiving section, where it is milled by the rotation of the rotary members.

14 Claims, 6 Drawing Figures

DRILLING BIT

FIELD OF THE INVENTION

The present invention relates to earth drilling tools, and more particularly to drilling bits for drilling oil and gas wells.

SUMMARY OF THE INVENTION

The present invention comprises a drilling bit comprising a drill body formed from a base portion and a crown portion. A plurality of cutting elements are supported on the crown portion, which is characterized by an external opening communicating with a core channel. The drill body further comprises a connecting portion, intermediate the base and crown portions, having a core-receiving section communicating with the core channel. The drilling bit further comprises core milling means, rotatably disposed in the connecting portion, for milling core material within the core-receiving section.

DETAILED DESCRIPTION OF THE PREFERRED EMBODIMENT

Figure 1:
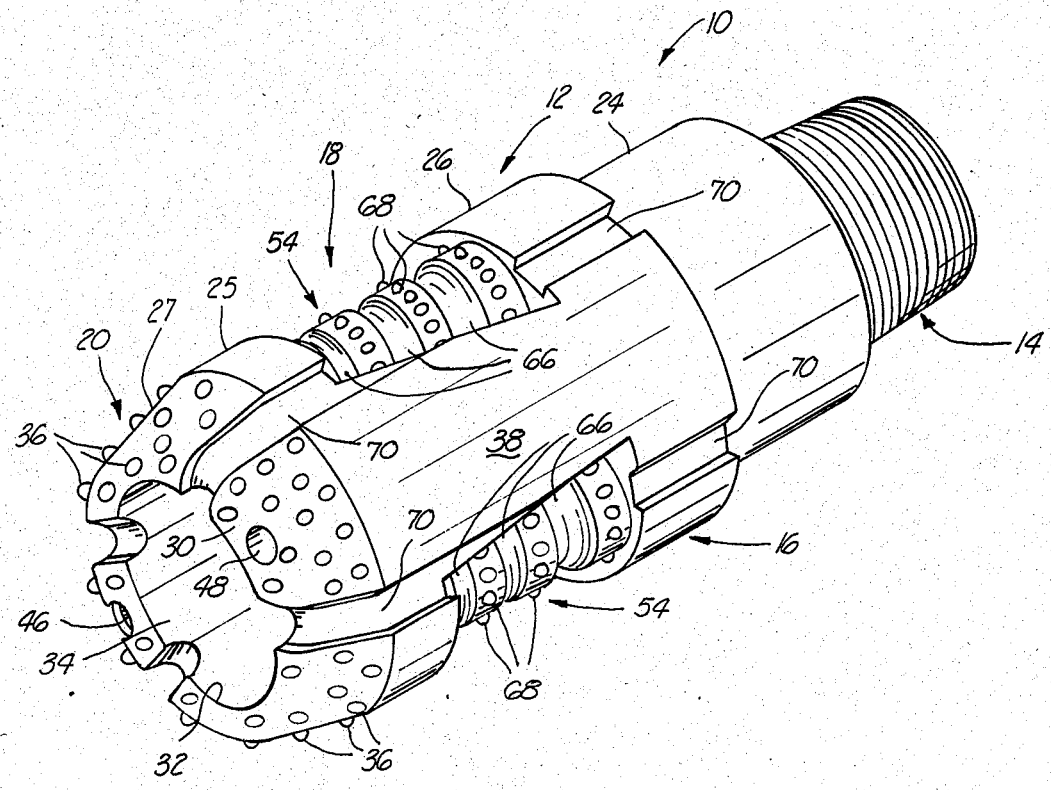
FIG. 1 is an isometric view of the drilling bit of the present invention.

With reference to FIG. 1, the drilling bit of the present invention, generally designated by reference numeral 10 comprises a drill body 12 having a collar portion 14, a base portion 16, a connecting portion 18 and a crown portion 20.

Figure 2:
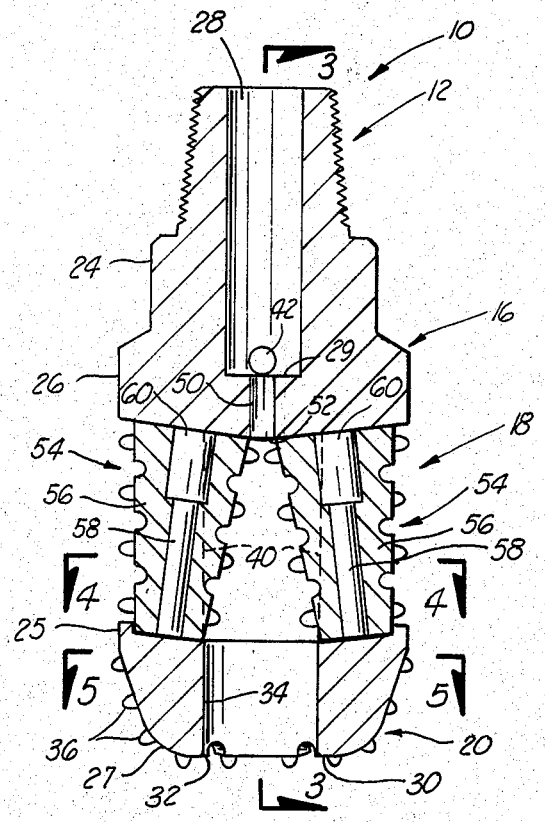
FIG. 2 is a cross-sectional side elevational view of the drilling bit of the present invention.
Figure 3:
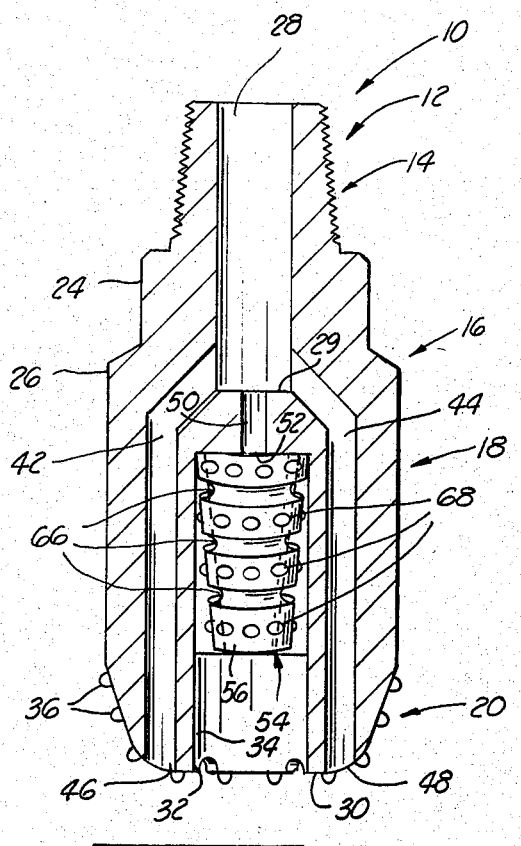
FIG. 3 is a cross-sectional side elevational view of the drilling bit of the present invention, taken along line 3—3 shown in FIG. 2.
Figure 6:
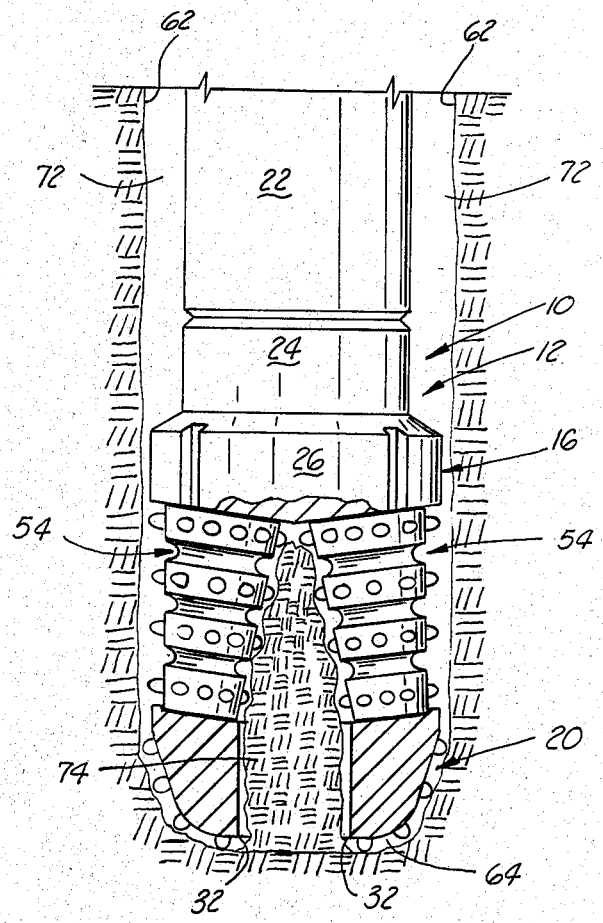
FIG. 6 is a side elevational view of the drilling bit of the present invention, shown in operating configuration in a drill hole. The connecting portion of the drilling bit has been partially cut away, in order to permit better display of other components of the invention.

As shown in FIGS. 1, 2 and 3, the collar portion 14 is a hollow member having two open ends and having a threaded external surface, such threads preferably conforming to American Petroleum Institute specifications. The collar portion 14 is sized to be threadedly received within the lower portion of a drilling string 22, as best shown in FIG. 6. When the collar portion 14 is thus received in the drilling string 22, the base portion 16 is disposed in end-to-end engagement with the drilling string 22.

Integrally and coaxially disposed with respect to the collar portion 14 is the base portion 16. As best shown in FIGS. 1, 2 and 3, the base portion 16 is a hollow member having an open end which fluidly communicates with an open end of the collar portion 14. The base portion 16 comprises a tubular shank 24, having an outer diameter approximately equal to that of the lower portion of the drilling string 22 with which the drilling bit 10 is to be used. The base portion 16 further comprises a base stabilizer section 26, integral and coaxial with the shank 24. The base stabilizer section 26, which is preferably characterized by substantially cylindrical side walls, preferably has an outer dimension slightly smaller than that of the hole to be formed by the drilling bit 10. The shank 24 may be provided with grippable recessed surfaces (not shown) in order to facilitate the breaking of the drilling bit 10 from a drilling string to which it is attached.

As best shown in FIGS. 2 and 3, the hollow portions of the collar portion 14 and base portion 16 communicate to form a tubular fluid channel 28. The fluid channel 28 communicates with the interior of the drilling string 22, and receives drilling fluid flowing downwardly through the drilling string 22. The fluid channel 28 terminates within the base stabilizer section 26 of the base portion 16 at a terminus 29. The manner in which drilling fluid reaching this terminus 29 of the fluid channel 28 is delivered to the cutting location will be described hereafter.

Further comprising the drill body 12 is the crown portion 20, best shown in FIGS. 1, 2, 3, 5 and 6. The crown portion 20, which is disposed coaxially with respect to the collar portion 14 and base portion 16, is characterized by an annular cross-section, and comprises a crown stabilizer section 25 and an adjacent cutting section 27. At a position nearest the base portion 16, the crown stabilizer section 25 of the crown portion 20 is characterized by an outside diameter approximatey equal to that of the upper stabilizer section 26 of the base portion 16. The crown section 20 is characterized by a maximum outside diameter at the portion of the crown stabilizer section 25 nearest the base portion 16.

As shown in FIGS. 1, 2, 3 and 6, the cutting section 27 of the crown portion 20 preferably comprises a substantially flat section 30 at the extremity of the drill body 12 and crown portion 20. The crown portion 20 is characterized by a minimum outside diameter at the flat section 30 of the cutting section 27. As best shown in FIGS. 2 and 3, the cutting section 27 gradually tapers between its maximum and minimum outside diameters; preferably, the cutting section 27 defines an at least partially elliptical or curved cross-sectional contour.

Figure 5:
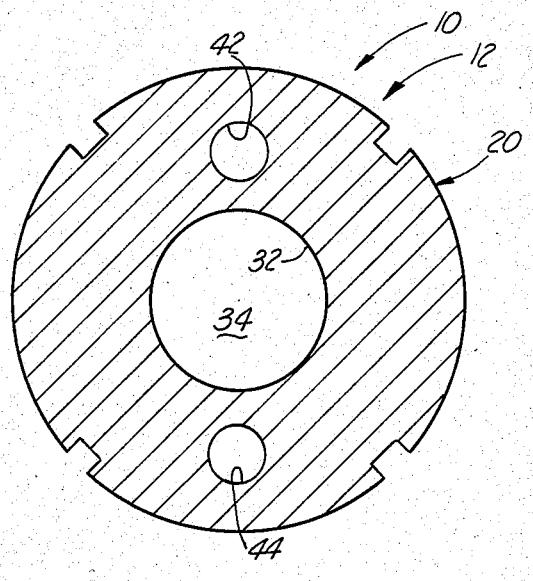
FIG. 5 is a cross-sectional plan view of the drilling bit of the present invention, taken along line 5—5 shown in FIG. 2.

As best shown in FIGS. 2, 3 and 5, an external opening 32 is formed in the flat section 30 of the cutting section 27 of the crown portion 20, in coaxial disposition to the crown portion 20. The external opening 32 is preferably circular in contour and communicates with a core channel 34 formed in the crown section 20. The core channel 34 is preferably characterized by cylindrical walls which are coaxially disposed with respect to the crown portion 20, base portion 16 and collar portion 14. One open end of the core channel 34 communicates with the just-described external opening 32. The other open end of the core channel communicates with connecting portion 18, as will be described in greater detail hereafter.

The cross-sectional dimensions of the external opening 32 and core channel 34 will depend on the type of earth or rock with which the drilling bit 10 is to be used. With softer earth or rock, a smaller opening is preferable; in harder earth or rock, a larger opening size is preferable.

Supported on the external surface of the cutting section 27 of the crown portion 20 are a plurality of cutting elements 36 formed from a hard, abrasion-resistant material; the elements 36 preferably comprise synthetic diamond compacts. The cutting elements 36 are secured to, and protrude from the external surface of the cutting section 27. The cutting elements 36 are preferably positioned so that each cutting element 36 moves in a circle of different radius upon rotation of the drill body 12. This positioning assures maximum cutting effect from the cutting elements 36.

Figure 4:
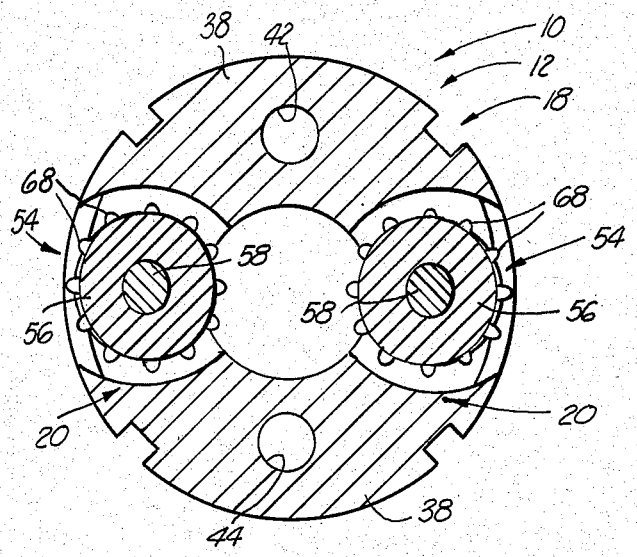
FIG. 4 is a cross-sectional plan view of the drilling bit of the prsent invention, taken along line 4—4 shown in FIG. 2.

With reference to FIGS. 1, 2, 3 and 4, the crown portion 20 and the base portion 16 are interconnected by the connecting portion 18, which is positioned intermediate the crown portion 20 and the base portion 16. Comprising the connecting portion 18 are a pair of structural members 38, each of which integrally interengage the base stabilizer section 26 of the base portion 16 with the crown stabilizer section 25 of the crown portion 20. The structural members 38 may be of solid construction, as shown in the Figures, or they may have openings formed therein. As best shown in FIG. 4, the structural members 38 are symmetrically disposed about the axis of the drill body 12. The outside diameter of each structural member 38 is preferably equal to that of the base stabilizer section 26 of the base portion 16. The outer surface of each structural member 38 is preferably disposable in adjacent relationship to the walls 62 of a hole 64 drilled by the drilling bit 10 and crown portion 20.

Apart from the structural members 38 and the core milling assembly to be described hereafter, the connecting portion 18 comprises empty space, as best shown in FIGS. 1, 2 and 3. This empty space permits the connecting portion 18 to communicate with the annulus of a hole drilled with the drilling bit 10, and with the core channel 34. One section of the connecting portion 18 is designated as the core-receiving section 40, and is shown in dashed lines in FIG. 2.

The core-receiving section 40 communicates with the end of the core channel 34, is disposed coaxially with respect to the core channel 34, and is characterized by the same cross-sectional dimensions as the narrowest portion of the core channel 34. The core-receiving section 40 extends within the connecting portion 18 between the base portion 16 and the crown portion 20. It should be understood that the core-receiving section 40 comprises a designated region of the connecting portion 18, and is not formed from any physical component of the present invention.

With reference to FIGS. 1–5, it will be recalled that the fluid channel 28 terminates within the base stabilizer section 26 of the base portion 16 at a terminus 29. The fluid distribution system extending from this terminus 29 will now be described. As best shown in FIG. 3, the lower terminus 29 of the fluid channel 28 communicates with a first fluid conduit 42 and a second fluid conduit 44. The first fluid conduit 42 extends through the interior portion of the base portion 16, the interior portion of one structural member 38, the interior portion of the crown portion 20, and terminates in a first fluid outlet 46 formed in the external surface of the crown portion 20. The second fluid conduit 44 extends through the interior portion of the base portion 16, the interior portion of the other structural member 38, and the interior portion of the crown portion 20, and terminates in a second fluid outlet 48 formed in the external surface of the crown portion 20.

With reference to FIGS. 2 and 3, a third fluid conduit 50 extends coaxially from the lower terminus 29 of the fluid channel 28 and extends through the lower section 26 and terminates in a third fluid outlet 52 formed in the base stabilizer section 26 and communicating with connecting section 18. From the foregoing description, it will be understood that fluid flowing into the fluid channel 28 is distributed at the first and second fluid outlets 46 and 48, on the crown portion 20, and into the connecting portion 18 by the third fluid outlet 52. Each of the fluid conduits 42, 44 and 50 is sized to permit flow of sufficient fluid to cool the drilling bit 10 and to transport earth cuttings adjacent each of the fluid outlets 46, 48 and 52.

With continued reference to FIGS. 1–6, the drilling bit 10 of the present invention further comprises a core milling assembly 54, rotatably disposed in the connecting portion 18, for milling and/or disintegrating core material within the core-receiving section 40. Comprising the core milling assembly 54 are a plurality of rotary members 56 symmetrically disposed about the axis of the drill body 12; each rotary member 56 is rotatably supported within the connecting portion 18. Preferably, two rotary members 56 are provided, which are disposed symmetrically with respect to the core-receiving section 40.

As best shown in FIG. 2, each rotary member 56 is preferably shaped as a right conical frustum. The enlarged end of each rotary member 56 is characterized by a larger diameter than the distance separating the structural members 38. Each rotary member 56 is supported on a shaft 58 which is in turn rotatingly engaged at opposite ends, by bearings (not shown), with the base portion 16 and the crown portion 20. In the embodiment shown in the Figures, the base portion 16 is provided with standards 60, which receive the shaft 58. Each rotary member 56 is characterized by a hollow portion in which the standard 60 is received.

As best shown in FIG. 2, each rotary member 56 is preferably oriented so that its enlarged end is positioned adjacent the base portion 16, and its small end is positioned adjacent the crown portion 20. The shaft 58 of each rotary member 56, and thus the rotational axis of each rotary member 56, is disposed in oblique relationship to the axes of the core-receiving section 40 and the drill body 12. A portion of each rotary member 56 extends transversely within the core-receiving section 40. When each rotary member 56 rotates about its rotational axis, successive portions of each rotary member 56 are caused to move through the core-receiving section 40.

From the foregoing, it will be understood that the edge of each rotary member 56 disposed adjacent the core-receiving section 40 will extend transversely within the core-receiving section 40. As shown in FIG. 2, the edge of each rotary member 56 adjacent the core-receiving section 40 is disposed nearest the axis of the core-receiving section 40 adjacent the base portion 16. The edge of each rotary member 56 adjacent the core-receiving section 40 is disposed farthest from the axis of the core-receiving section 40 adjacent the crown portion 20. Thus, each rotary member 56 tapers into the core-receiving channel 40.

Because of the frustum shape of the rotary members 56, the edge of each rotary member 56 most remote from the core-receiving section 40 will extend in parallel or substantially parallel disposition to the axis of the drill body 12, as best shown in FIG. 2. This edge of each rotary member 56 is thus disposable in parallel or substantially parallel adjacent relationship to the side walls 62 of a hole cut by the crown portion 20 of the drill body 12, as best shown in FIG. 6.

Because the edge of each rotary member 56 remote from the core-receiving section 40 is disposable in parallel or substantially parallel adjacent relationship to side walls 62, each rotary member 56 and its cutting elements 68 may function both as a core milling assembly and as a gauge maintenance assembly, for maintaining the gauge of a hole cut by the crown portion 20 of the drill body 12. The structural members 38 of the connecting section 18, the base stabilizer section 26 of the base portion 16 and the crown stabilizer section 25 of the crown portion 20 each perform a similar gauge protection function. The operation of these features will be described in greater detail hereafter.

As best shown in FIGS. 1 and 3, a plurality of cuttings-receiving grooves 66 are formed in the external surface of each rotary member 56. The grooves 66 extend coaxially with respect to the rotational axis of each rotary member 56, and are axially spaced from one another. A plurality of cutting elements 68, formed from a hard, abrasion-resistant substance, are supported on the ungrooved portions of each rotary member 56. The cutting elements 68 protrude from and are secured to each rotary member 56, and preferably comprise tungsten carbide inserts.

As best shown in FIGS. 1, 2 and 3, the cutting elements 58 are preferably uniformly distributed about the ungrooved surface of each rotary member 56. Consequently, at any rotational position of a rotary member 56, less than all of its cutting elements 68 will be positioned within the core-receiving section 40. The consequences of this feature will be discussed in greater detail hereafter.

Further comprising the drilling bit 10 of the present invention are a plurality of fluted channels 70, shown in FIG. 1. Each channel 70 preferably extends from the external opening 32 in the crown section 20 and terminates adjacent the shank 24 of the base portion 16. As shown in FIG. 1, each channel 70 may be interrupted by empty spaces in the connecting section 18. The channels 70 function as a return conduit for drilling fluid carrying earth cuttings produced during operation of the drilling bit 10.

The collar portion 14, the base portion 16, the structural members 38 of the connecting portion 18, the crown portion 20, and the core milling assembly 54 are all preferably formed from a sturdy, stress-resistant material such as a high grade heat-treated steel.

With reference to FIG. 6, the drilling bit 10 of the present invention is operated by threading the collar portion 14 of the drilling bit 10 into engagement with the lower portion of a drilling string 22. The drilling bit 10 and string 22 are positioned over a portion of earth in which a hole is to be drilled, as is required in the drilling of oil, gas and other types of wells. The drilling string 22 is then rotated under downward pressure, causing the crown portion 20 to rotate. Rotation of the crown section 20 under downward pressure causes the cutting elements 36 to drill a hole 64 having side walls 62. Earth cuttings produced by this drilling are removed and carried by drilling fluid into the annulus 72 between the walls 62 and the drilling string 22.

Because an external opening 32 is formed in the crown portion 20, the portion of earth underlying the external opening 32 will not be cut by the crown portion 20 during the drilling process just described. Instead, the earth underlying the external opening 32 will remain as a core 74. As the drilling bit 10 progresses more deeply into the earth the core 74 will be received first in the core channel 34, and thereafter in the core-receiving section 40 of the connecting section 18. As the core 74 enters the connecting section 18, the core 74 will have cross-sectional dimensions approximately equal to those of the narrowest portion of the core channel 34.

As the drill body 12 penetrates into the hole 64, the core 74 is received within the core-receiving section 40, and is contacted by the cutting elements 68 of the rotary members 56. Contact by the rotary members 56 with the core 74 drives rotation or rolling of each rotary member 56 about its rotational axis. This rotation causes milling or disintegration of the core 74 by the rotary members 56. The earth cuttings formed by this milling process are carried by drilling fluid into the grooves 66, thereafter into the channels 70, and thence into the annulus 72. Because the rotary members 56 taper transversely into the core-receiving channel 40, the core 74 is milled gradually as it is received in the channel 40, with the deepest milling cuts being formed adjacent the base section 16. As the core 74 is milled or disintegrated, the cutting elements 68 of the rotary member 56 contact the walls 62 of the hole 64, resulting in application of a retarding torque to each rotary member 56. As the drill body 12 rotates, the interaction between the torque applied to each rotary member 56 by the core 74 and the oppositely directed torque applied by the walls 62 results in a combination scraping-gouging action by the cutting elements 68.

Because the cutting elements 68 are axially spaced apart on each rotary member 56, step-like discontinuities are formed in the external surface of the core 74 as it is milled. As the core 74 is milled, stress builds up adjacent these discontinuities; this stress buildup promotes breakup of the core 74 adjacent the discontinuities, into relatively large pieces. Milling of the core 74 in this way increases the efficiency of the drilling bit 10 by reducing the amount of energy required to mill or disintegrate the core 74.

Because the rotary members are drivable by contact with both the walls 62 and the core 74, the wedging of a broken piece of core 74 within the core-receiving section 40 will not prevent rotation of the rotary members 56. In such an event, the torque applied to the rotary members 56 by the rotating contact with the walls 62 will drive rotation of the rotary members 56, and thus will force any broken core pieces out of wedging engagement with the rotary members 56. The flow of fluid through the third fluid outlet 52 will assist in the disengagement of any such wedged core pieces.

During the drilling and milling process just described, drilling fluid is pumped through the interior of the drilling string 22. This fluid is received in the fluid channel 28, and is thence received within the hole 64 via the first, second and third fluid outlets 46, 48 and 52. The drilling fluid serves to cool the drilling bit 10, and to transport earth cuttings to the surface through the annulus 72.

As the rotary members 56 mill the core 74 within the core-receiving section 40, the edge of each rotary member 56 remote from the core-receiving section 40 is disposed in parallel or near-parallel adjacent relationship to the side walls 62 of the hole 64. Thus, as the rotary members 56 rotate about the axis of the drill body 12 and about their own rotational axes, the successive positioning of cutting elements 68 adjacent the side walls 62 will function to maintain the gauge of the hole 64 and minimize the drag forces between the drilling bit 10 and the walls 62. The structural members 38 of the connecting portion 18, the base stabilizer section 26 of the base portion 16, and the crown stabilizer section 25 of the crown portion 20 each perform a similar gauge protection function.

From the foregoing description, it will be understood that the drilling bit 10 of the present invention dispenses with the weakest portion of the crown of the bit: the central portion nearest the rotational axis of the drilling bit 10, where cutting element redundancy is not completely possible because of space limitations. In lieu of this central portion of the crown, there is provided an external opening 32 communicating with a core channel 34. The core channel 34 causes the formation of a core, which is milled principally under the combination of tensile and compressive forces applied by the rotary members 56, rather than by the pure compressive forces applied by the crown portion 20. The rotary members 56 permit the milling of the core by a redundant configuration of cutting elements, which are spaced axially and circumferentially about the rotary members 56.

The milling operation conducted by the rotary members 56 does not involve continuous contact by the cutting elements 68 with the core 74. Because not all of the cutting elements 68 are engaged with the core 74 or walls 62 at any given moment, and because the identity of the cutting elements 68 contacting the walls 62 and core 74 change continuously, the cutting elements 68 are much less likely to fail than would cutting elements in a section of crown portion disposed at the site of the external opening 32. A further consequence of this feature is that higher downward thrust forces may be applied through the drilling bit 10 for a given load, thus permitting a higher rate of penetration by the bit 10.

It will be noted that the base portion 16 and crown portion 20 rotatably support the shaft 58 at opposite ends, thereby forming a cage-like structure which holds the rotary members 56 in place during drilling operation. This cage-like structure provided by the drill body 12 reduces the likelihood that a rotary member 56 will be disassociated from the drilling bit 10. It will be recalled that the diameter of the enlarged portion of each rotary member 56 exceeds the distance between the structural members 38; thus the rotary member 56 cannot escape from the connecting section 18 even if the shaft 58 becomes disengaged from its supports. In view of these features, time-consuming fishing operations for lost drill bit components will ordinarily not be required with the drilling bit 10.

It will further be noted that the shaft 58 of each rotary member 56 is oriented at a small angle, substantially less than 45°, with respect to the axis of the drill body 12, and is thus oriented at the same small angle with respect to the downward force applied by the drilling string 22. Because of the orientation of the shafts 58 with respect to the vertical forces applied to the drill body, there is a relatively small component of force applied perpendicularly to each shaft 58, and there is thus only a small bending moment on each shaft 58. The smallness of the bending moment reduces wear on the bearings supporting the shaft 58, and prolongs the life of the drilling bit 10. The orientation of the shafts 58 thus reduces the likelihood that the shafts 58 will fail during drilling, and accordingly reduces the likelihood that the rotary members 56 will become disassociated from the drilling bit 10.

It will also be observed that the drilling bit 10 offers a substantial stabilizing effect against deviations of the hole 64 from the desired drilling direction. This stabilization is provided by the base stabilizer section 26, the crown stabilizer section 25 and the structural members 38, all of which have a diameter substantially equal to that of the hole 64. Because much of the connecting section 18, which is disposed intermediate the upper and lower stabilizer section 25 and 26, does not contact the walls 62, the bit 10 offers good stability even though much of the bit surface does not contact the walls 62. Minimizing the area of contact between the bit 10 and the walls 62 minimizes the drag forces which can restrain movement of the bit 10.

Changes may be made in the construction and operation of the various parts, elements and assemblies described herein without departing from the spirit and scope of the invention as defined in the following claims.

What is claimed is:

1. A drilling bit comprising:
a drill body comprising:
a base portion;
a crown portion having a plurality of cutting elements supported thereon, the crown portion having an external opening communicating with a core channel; and
a connecting portion, intermediate the base and crown portions, having a core-receiving section communicating with the core channel; and
core milling means, rotatably disposed in the connecting portion and drivable by an external torque applied to the drilling bit, for milling core material within the core-receiving section, the core milling means comprising:
a plurality of rotary members, each rotary member having a rotational axis disposed in oblique relationship to the core-receiving section, each rotary member comprising a right conical frustum characterized by a base surface and a top surface interconnected by a lateral surface, the lateral surface comprising:
an elongate outer edge portion disposable in substantially parallel, adjacent relationship to the side walls of a hole cut by the crown portion of the drill body; and
and elongate inner edge portion transversely extendable within the core-receiving section.

2. The apparatus of claim 1 in which each rotary member is supported on a shaft rotatingly engaged at opposite ends with the base portion and the crown portion.

3. The apparatus of claim 1 in which the core milling means comprises two rotary members disposed symmetrically with respect to the core-receiving section.

4. The apparatus of claim 1 and in which rotation of each rotary member causes movement of successive portions of each rotary member through the core-receiving section.

5. The apparatus of claim 1 further comprising:
gauge maintenance means, disposed within the connecting portion, for maintaining the gauge of a hole cut by the crown portion of the drill body.

6. The apparatus of claim 5 in which the gauge maintenance means comprises the rotary members.

7. The apparatus of claim 1 in which a plurality of cuttings-receiving grooves are formed in each rotary member, and in which cutting elements are disposed on the ungrooved portions of each rotary member.

8. The apparatus of claim 7 in which the cuttings-receiving groove of each rotary member are disposed coaxially with respect to the rotational axis of each rotary member.

9. The apparatus of claim 1 in which the core-receiving section of the connecting portion is characterized by cross-sectional dimensions identical to those of the narrowest portion of the core channel.

10. The apparatus of claim 1 in which a plurality of cutting elements are supported on each rotary member.

11. The apparatus of claim 10 in which each rotary member is characterized, at any rotational position thereof, as having less than all of its cutting elements disposed within the core-receiving section.

12. The apparatus of claim 1, in which the connecting portion comprises a plurality of spaced structural members and in which the maximum diameter of each rotary member exceeds the spacing between adjacent structural members.

13. The apparatus of claim 1 in which the base portion comprises:

a base stabilizer section disposed adjacent the connecting portion of the drill body;

in which the crown portion comprises:

a crown stabilizer section disposed adjacent the connecting portion of the drill body in opposed relationship to the base stabilizer section;

and in which the diametrical dimensions of the base and crown stabilizer are approximately equal to each other, and in which each stabilizer section is disposable in adjacent relationship to the walls of a hole out by the drilling bit.

14. The apparatus of claim 1 in which the outer edge portion of the rotary member is disposed in substantially non-overhanging relationship to the connecting portion of the drill body.

* * * * *